United States Patent [19]

Cooper

[11] 4,375,937

[45] Mar. 8, 1983

[54] ROTO-DYNAMIC PUMP WITH A BACKFLOW RECIRCULATOR

[75] Inventor: Paul Cooper, Titusville, N.J.

[73] Assignee: Ingersoll-Rand Company, Woodcliff Lake, N.J.

[21] Appl. No.: 229,295

[22] Filed: Jan. 28, 1981

[51] Int. Cl.[3] ..... F04D 13/12; F04D 29/68

[52] U.S. Cl. ..... 415/53 R; 415/59; 415/74; 415/143; 415/DIG. 1

[58] Field of Search ..... 415/11, 53 R, 74, 59, 415/143, DIG. 1

[56] References Cited

U.S. PATENT DOCUMENTS

| | | | |
|---|---|---|---|
| 2,658,338 | 11/1953 | Leduc | 415/DIG. 1 |
| 2,709,917 | 6/1955 | Bruynes | 415/DIG. 1 |
| 3,504,986 | 4/1970 | Jackson | 415/53 R X |

FOREIGN PATENT DOCUMENTS

| | | | |
|---|---|---|---|
| 2710514 | 9/1977 | Fed. Rep. of Germany | 415/53 R |
| 46-42817 | 12/1971 | Japan | 415/DIG. 1 |
| 52-11405 | 1/1977 | Japan | 415/143 |
| 136185 | 6/1960 | U.S.S.R. | 415/143 |

*Primary Examiner*—Philip R. Coe
*Attorney, Agent, or Firm*—R. J. Falkowski

[57] ABSTRACT

A roto-dynamic pump having recirculating means for preventing pump cavitation surging at low flow rates and at moderate to low values of net positive suction head.

7 Claims, 2 Drawing Figures

ROTO-DYNAMIC PUMP WITH A BACKFLOW RECIRCULATOR

BACKGROUND OF THE INVENTION

1. Field of the Invention

This invention relates to a roto-dynamic pump and more particulary a roto-dynamic pump having a recirculating means for eliminating pump cavitation.

2. Background

Roto-dynamic pumps are subjected to cavitation surges to low flow rates and at moderate to low values of net positive suction head. Low flow rates are generally flow rates of less than about 50% of maximum flow rate of the pump. Moderate to low values of net positive suction head (NPSH) are generally those that produce a pump pressure rise reduction of 1% to 3% below the pressure rise obtained in the absence of NPSH influence. In NASA publication NASA SP-8502 entitled "Liquid Rocket Engine Turbopump Inducers", May 1971, a design configuration on pages 33 and 34 is shown which attempts to contain backflow which occurs at low flow. This design, while containing backflow, has a structure protruding into the suction inlet of the pump which decreases the efficiency of the pump.

U.S. Pat. No. 3,677,659 to Williams shows a roto-dynamic pump wherein a pumping chamber communicates with a suction chamber by means of a slot. The slot allows flowing fluid to pass to the suction chamber and then to an inlet scroll for recirculation which tends to reduce pump cavitation.

U.S. Pat. No. 3,090,321 to Edwards relates to a vapor separation pump which has an arrangement of diffuser passages or openings which serve as vapor discharge outlets at low rates of flow and as secondary or auxiliary inlets at high rates of flow. The diffuser passages adjacent to the pump inlet are normally intended to function as vapor outlet openings.

U.S. Pat. No. 2,832,292 also to Edwards shows a roto-dynamic pump having a radially extending passage containing diffusion vanes which act as a vapor discharge or a secondary inlet. A lip at the end of the passage directs the discharge away from axial inlet.

U.S. Pat. No. 2,660,366 to Klein et al. pertains to fluid compressors of both the radial and axial flow types and to structural means and method of inhibiting surging in fluid flow in such compressors.

SUMMARY OF THE INVENTION

This invention pertains to a roto-dynamic pump having a housing containing a pump chamber, a leading edge region upstream of the pump chamber, an inlet region upstream of the leading edge region permitting fluid to enter the pump and an outlet region downstream of the pump chamber permitting fluid to discharge from the pump. A roto-dynamic means is provided in the pump chamber for pumping fluid entering the structure. As the pumping means rotates, swirling fluid may back-flow from the leading edge of the roto-dynamic means. A catching means at the leading edge region collects sufficient backflow fluid to prevent cavitation surging of the pump. A straightening means removes the swirl from the collected fluid and a delivery means returns the straightened fluid to the inlet region.

DESCRIPTION OF THE PREFERRED EMBODIMENTS

Figure 1:
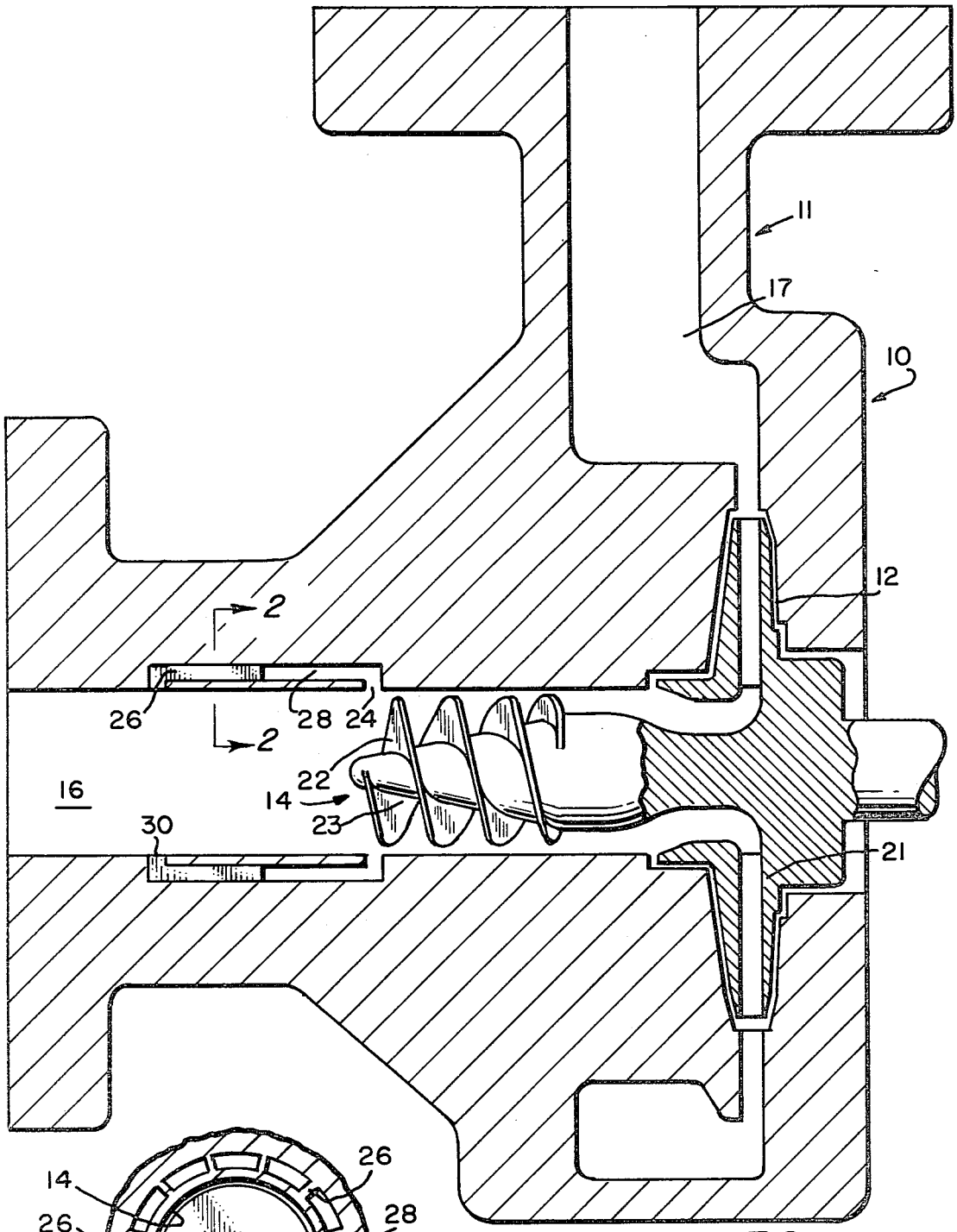
FIG. 1 is a schematic cross-section illustration of a roto-dynamic pump with an annular passage followed by an axial straightening passage.
Figure 2:
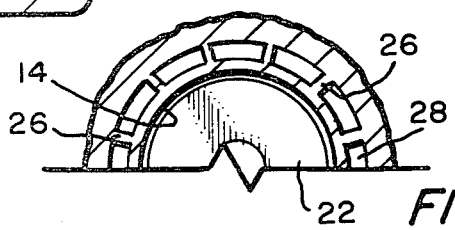
FIG. 2 is a partial cross-section illustration shown along line 2—2 in FIG. 1 showing strengthening vanes.

As shown in the figure a roto-dynamic pump 10 is comprised of a housing 11. Housing 11 includes conventional housing such as one piece castings and housing comprised of several pieces bolted or welded together. Roto-dynamic pump 10 also includes a pump chamber 12 and a roto-dynamic means within pumping chamber 12. Roto-dynamic means includes conventional roto-dynamic means such as impellers, inducers and an inducer 23 operating in conjunction with impeller 21 as shown in the figure. The roto-dynamic means has a leading edge 22 located on the upstream side of the roto-dynamic means.

Upstream of pumping chamber 12 is a leading edge region 14 through which fluid enters pumping chamber 12. The leading edge region is a portion of the flow passage that conveys the incoming fluid to leading edge 22 and surrounds the roto-dynamic means. The diameter of the leading edge region is that of this flow passage. Leading edge region 14 preferably extends upstream of leading edge 22 a distance equal to one-fifth the diameter of the leading edge region and extends downstream a distance also equal to one-fifth the diameter of the leading edge region. An inlet region 16 is provided upstream of leading edge region 14. Incoming fluid flows through inlet region 16, through leading edge region 14 and into pumping chamber 12. An outlet downstream of pump chamber 12 is provided for removing fluid from the pump. Outlet region includes conventional outlet regions such as a volute section 17 as shown in the figure and pipe sections.

According to the present invention a catching means is provided at the leading edge region for collecting sufficient backflow fluid from the roto-dynamic means to prevent cavitation surging of the pump. It is believed that cavitation surging of the pump occurs when sufficient liquid backflows from the roto-dynamic pumping chamber. The backflowing liquid is caused at low flow rates since liquid cannot move forward through the pump and hence backflows upstream. The backflowing liquid emanates from the leading edge of the pumping means which is rotating. The rotation causes the liquid to swirl upstream as it backflows. The swirling liquid tends to move towards the wall of the inlet region by means of centrifugal force. This results in a low pressure in the center of the inlet region. In order to avoid cavitation surge at low NPSH values the swirling liquid must be removed from this region, straightened and re-introduced in a non-swirling manner.

The catching means includes conventional opening means such as annular slot 24 and holes. In an embodiment of the invention the annular slot is perpendicular to the flow of the fluid in leading edge region 14. This allows for the backflowing fluid to be caught without interfering with the incoming flow to the pumping chamber and hence without interfering with the performance of the pump. When an annular slot is employed it has been found the annular slot should be at least one-tenth the diameter of leading edge region 14 in order to allow the catching of sufficient backflowing fluid to prevent cavitation surging of the pump. A means is also provided for straightening or removing the swirl from the collecting fluid. The straightening means includes means such as an annulus 28. The annulus may include additional straightening means such as straightening vanes 26.

It has been found the length of the annulus should be at least about three-fourths the diameter of the leading edge region and preferably equal to or greater than the diameter of the leading edge region. A delivery means is provided for returning the straightened fluid to inlet region 16. Delivery means includes conventional delivery means such as annular slot 30 and holes. The annular slot width should be at least one-tenth the diameter of the leading edge region. It is desired to introduce the straightened fluid to inlet region 16 at a direction substantially perpendicular to the flow of the fluid in inlet region 16.

The embodiment shown in the figure has been found suitable to end suction pumps that have substantial lengths of axial straight pipe feeding the inlet of the pump.

I claim:

1. A roto-dynamic pump comprising:

(a) a housing having a pump chamber, a leading edge region upstream of the pump chamber, an inlet region upstream of the leading edge region permitting fluid to enter the pump and an outlet region downstream of the pump chamber permitting fluid to discharge from the pump;

(b) a roto-dynamic means in the pump chamber for pumping fluid entering the structure wherein the roto-dynamic means has a leading edge;

(c) a first annular slot substantially parallel to the flow of fluid in the leading edge region for collecting sufficient swirling backflow fluid caused by the roto-dynamic means to prevent cavitation surging of the pump;

(d) an annulus for removing the swirl from the collected fluid wherein the annulus comprises straightening vanes and wherein the length of the annulus is at least about three-fourths the diameter of the leading edge region; and (e) a second annular slot for returning the straightened fluid into the inlet region at a direction substantially perpendicular to that of the incoming fluid in the inlet region.

2. A roto-dynamic pump according to claim 1, wherein the leading edge region extends upstream and extends downstream from the leading edge a distance equal to one-fifth the diameter of the leading edge region.

3. A roto-dynamic pump according to claim 1, wherein the roto-dynamic means is an impeller.

4. A roto-dynamic pump according to claim 1, wherein the roto-dynamic means is an inducer.

5. A roto-dynamic pump according to claim 1, wherein the roto-dynamic means is an inducer operating in conjunction with an impeller.

6. A roto-dynamic pump according to claim 1, wherein the width of the first annular slot is at least one-tenth the diameter of the leading edge region.

7. A roto-dynamic pump according to claim 1, wherein the width of the second annular slot is at least one-tenth the diameter of the leading edge region.

* * * * *